US011560684B2

(12) United States Patent
Goy et al.

(10) Patent No.: US 11,560,684 B2
(45) Date of Patent: Jan. 24, 2023

(54) FORMWORK ELEMENT PROVIDED WITH SACRIFICIAL SECTIONS

(71) Applicant: SOLETANCHE FREYSSINET, Rueil Malmaison (FR)

(72) Inventors: Christophe Goy, Rueil Malmaison (FR); Léon Ndangba, Rueil Malmaison (FR); Marc Novel, Rueil Malmaison (FR)

( * ) Notice: Subject to any disclaimer, the term of this patent is extended or adjusted under 35 U.S.C. 154(b) by 0 days.

(21) Appl. No.: 17/253,728

(22) PCT Filed: Jun. 26, 2019

(86) PCT No.: PCT/FR2019/051578
§ 371 (c)(1),
(2) Date: Dec. 18, 2020

(87) PCT Pub. No.: WO2020/002836
PCT Pub. Date: Jan. 2, 2020

(65) Prior Publication Data

US 2021/0363720 A1 Nov. 25, 2021

(30) Foreign Application Priority Data

Jun. 27, 2018 (FR) ..... 18 55779

(51) Int. Cl.
*E02D 5/18* (2006.01)
*E02D 17/13* (2006.01)
(Continued)

(52) U.S. Cl.
CPC ..... *E02D 5/182* (2013.01); *E02D 17/13* (2013.01); *E02D 27/30* (2013.01); *E04G 19/00* (2013.01);
(Continued)

(58) Field of Classification Search
CPC .. E02D 5/18; E02D 5/182; E02D 3/12; E02D 17/13
(Continued)

(56) References Cited

U.S. PATENT DOCUMENTS 3,416,322 A * 12/1968 Bodine ..... E02D 5/20 405/267
3,464,665 A * 9/1969 Schoewert ..... E02D 5/182 249/10
(Continued)

FOREIGN PATENT DOCUMENTS

EP 1039038 A1 9/2000
FR 2145758 A5 2/1973
(Continued)

OTHER PUBLICATIONS

Machine translation of FR2145758A5.

*Primary Examiner* — Frederick L Lagman
(74) *Attorney, Agent, or Firm* — Robert Facey

(57) ABSTRACT

A formwork element for a molded wall panel end, comprising: a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson; a form stripping assistance device cooperating with the sole plate. The form stripping assistance device includes at least one first sacrificial section comprising a first portion disposed on the first lateral zone of the inner face of the sole plate.

18 Claims, 6 Drawing Sheets

(51) Int. Cl.
*E02D 27/30* (2006.01)
*E04G 19/00* (2006.01)

(52) U.S. Cl.
CPC ..... *E02D 2250/0007* (2013.01); *E02D 2250/0023* (2013.01); *E02D 2300/002* (2013.01)

(58) Field of Classification Search
USPC ..... 405/267
See application file for complete search history.

(56) References Cited

U.S. PATENT DOCUMENTS 3,564,855 A * 2/1971 Morner ..... E02D 5/182 405/267
3,766,695 A * 10/1973 Morner ..... E02D 5/185 52/127.3
3,796,054 A * 3/1974 Piccagli ..... E02D 5/185 405/267
4,453,862 A * 6/1984 Stenne ..... E02D 5/182 264/33
4,582,453 A * 4/1986 Ressi di Cervia ..... E02D 5/182 405/267
5,354,149 A * 10/1994 Breaux ..... B09B 1/008 405/129.6
6,052,963 A * 4/2000 Lefort ..... E02D 5/182 405/267
6,332,297 B1 12/2001 Butigieg

FOREIGN PATENT DOCUMENTS

FR 2473091 A1 * 7/1981 ..... E02D 5/182
FR 3109163 A1 * 10/2021 ..... E02D 5/185
JP 05280041 A * 10/1993 ..... E02D 5/185

* cited by examiner

FORMWORK ELEMENT PROVIDED WITH SACRIFICIAL SECTIONS

FIELD

The present disclosure relates to a formwork element for a molded wall panel.

In known fashion, when it is desired to make a molded wall, i.e. a wall made of concrete in a trench dug into the ground, this operation is carried out in successive slices, each corresponding to a molded wall panel, the panel assembly constituting the wall.

To ensure the mechanical continuity of the panels of the wall in the connection zone between two panels, a particular shape is given to the end of each panel, which allows the embedding of one end of a panel in the end of the preceding panel. This shape is obtained by means of a formwork element which generally includes a seal. More precisely, this formwork element is place at one end of the trench, before the concreting of said trench.

The present disclosure relates more particularly to a formwork element for a molded wall panel end, said formwork element extending in a longitudinal direction and comprising:

a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson.

The first lateral edge is therefore disposed between the outer face and the inner face bearing the caisson.

BACKGROUND

One known problem is that, during the concreting step, the concrete has a tendency to bypass the formwork element. After hardening, the concrete adheres to the formwork element, which makes its extraction from the trench difficult.

To solve this problem, EP 1 039 038 teaches the use of a form stripping assistance device cooperating with the sole plate.

This form stripping assistance device consists of sacrificial rectangular elements which are disposed along the lateral edges of the sole plate, the lateral edges consisting of the end edges of the sole plate.

To accomplish form stripping, it is known to use a form stripping device, known per se, provided with form stripping hooks which are moved along the first and second lateral edges to detach the formwork element from the concrete.

If the rectangular elements described in EP 1 039 038 give complete satisfaction for trenches of small and medium depth, the inventors have noted that they were less effective for trenches of great depth, i.e. more than 40 meters.

SUMMARY

One aim of the present disclosure is to propose a formwork element allowing the facilitation of the step of stripping forms after concreting.

To this end, the form stripping assistance device of the formwork element according to the present disclosure includes at least one first sacrificial section comprising a first portion disposed on the first lateral zone of the inner face of the sole plate.

The first portion is therefore a first sacrificial section portion which extends over the first lateral zone of the inner face of the sole plate, between the first lateral edge and the caisson. The first lateral zone is substantially parallel to the outer face.

The first sacrificial section also extends in the longitudinal direction of the sole plate.

The first portion, which may extend in the longitudinal direction of the sole plate, may allow avoiding having the concrete adhere to the inner face at the first lateral zone. In the absence of a first sacrificial section within the meaning of the present disclosure, the first lateral zone of the inner face has a large adhesion surface with the concrete, which may make disengagement of the formwork element difficult. The first sacrificial portion, which is destroyed during the passage of the hooks of the form stripping device, may have the effect of preventing, or at the very least substantially limiting, the adhesion of the concrete to the first lateral zone, which consequently facilitates the subsequent disengagement of the formwork element.

The first portion may have a width, considered in a direction transverse to the longitudinal direction of the formwork element, which is greater than one-third of the width of the first lateral zone. The width of the first portion may be greater than half the width of the first lateral zone. Additionally, the first portion may extend substantially until the caisson. One benefit may be to be able to cover the largest possible surface at the internal face of the sole plat in order to facilitate the subsequent form stripping of the formwork element.

To accomplish the form stripping of the formwork element according to the present disclosure, a form stripping device provided with a first hook formed to engage between the concrete and the inner face of the sole plate may be used, within the thickness of the first portion, so as to be able to destroy the first portion of the first sacrificial section during the vertical movement of the form stripping device.

The first sacrificial section may also include a second portion disposed on the outer face of the sole plate. The second portion is a second sacrificial section portion.

The Inventors have noted, moreover, that during concreting of a trench of great depth, the concrete can have a tendency to bypass the sole plate and come into contact with its outer face. After hardening and in the absence of a form stripping assistance device according to the present disclosure, the concrete may then adhere to the sole plate and make withdrawal of the form stripping element from the trench difficult.

The second portion may allow prevention of the concrete, having bypassed the first lateral edge of the sole plate from adhering to the outer face of the sole plate. Thanks to the technology of the present disclosure, the concrete which bypasses the first lateral edge of the sole plate would, at most, adhere against the second portion of the first sacrificial element. This second portion, to which the concrete may possibly have adhered, can then be destroyed during subsequent digging of the adjacent trench. The excavated fragments of concrete and of the second portion can then be removed by pumping during the excavation of the adjacent trench. This may have the effect of reducing the adhesion between the concrete and the sole plate, which may facilitate the subsequent extraction of the formwork element from the trench.

Considered in a direction transverse to the longitudinal direction, the width of the second portion may be greater than the width of the first portion. One benefit may be to cover a surface of the outer face which is greater than the surface of the first lateral zone.

Additionally, the thickness of the second portion may be substantially equal to the thickness of the first portion.

The first sacrificial section may also include a third portion disposed along the first lateral edge, the third portion being fastened to the first and second portions of the first sacrificial section. The third portion is a third sacrificial section portion.

The third portion may have the effect of preventing the concrete from adhering to the first lateral edge. It may also facilitate the engagement of the form stripping hands.

The first form stripping hand of the form stripping device may be formed to move vertically within the thickness of the third portion, which may have the effect of destroying the third portion during the vertical movement of the form stripping device. This may allow detaching the first vertical edge of the concrete, and consequently, possibly facilitating the withdrawal of the formwork element from the trench.

The first, second and third portions may form a single unitary part.

The first sacrificial element may therefore be one-piece. One benefit may be to be able to easily and rapidly assemble the first sacrificial element to the sole plate. This may also facilitate the manufacture of the first sacrificial element.

The thickness of the third portion may be substantially equal to the thickness of the first portion.

Additionally, the distance between the first and second portions may be substantially equal to the thickness of the sole plate.

It will therefore be understood that the first sacrificial element may clasp the first lateral edge of the sole plate, which may allow prevention of the concrete from adhering to the sole plate.

Considered in a direction transverse to the longitudinal direction, the width of the second portion may be greater than one-third and less than half the width of the sole plate. One benefit may be to leave a passage for the flow of mud during the placement of the formwork element in the trench.

The first sacrificial section may consist of a brittle material, so that it can easily be destroyed or shredded by the form stripping device. It is also understood that the first sacrificial section, for example the second portion, is destroyed during the digging of the adjacent trench.

The brittle material may have a density comprised between 10 and 60 kg/m$^3$, possibly comprised between 15 and 45 kg/m$^3$.

The first sacrificial section may be made of polystyrene.

In other words, at least the first section may consist of a brittle material, polystyrene for example.

The formwork element according to the present disclosure may also include a fastening device for fastening the first sacrificial section to the sole plate.

The fastening device may include one or more slender elements, such as wires, straps or small cross-section cables, which clasp the formwork element in order to hold the first sacrificial section with the sold plate during the introduction of the formwork element into the trench and during concreting. Shims may be disposed between the caisson and the slender elements in order to avoid crushing of the seal. The fastening devices may be dimensioned to be split during the passage of the form stripping device or during the digging with mud of the adjacent trench. The residues are removed from the trench by pumping or by a skip during the excavation of the adjacent trench.

The fastening device may also include a holding device to hold the first sacrificial section against the outer face of the formwork element. The fastening device may consist of a brittle or splittable material. This holding device may comprise one or more plates, of wood for example, extending along the second portion.

The holding device may include a spacer portion to maintain a longitudinal space between two adjacent formwork elements. One benefit may be to ensure the alignment of the sections while reducing the necessary quantity of polystyrene.

The fastening device may include at least one breakable rod which passes through and holds the sole plate in a sandwich together with the first and second portions of the first sacrificial section, the rod extending perpendicular to the outer face of the sole plate.

The formwork element may also include at least one second sacrificial section including a first portion disposed on the second lateral zone.

It is therefore understood that the first portions of the first and second sacrificial sections may extend on either side of the caisson, for example in the longitudinal direction of the formwork element.

The second sacrificial section may also include a second portion disposed on the outer face of the sole plate. The second portion of the second sacrificial section may be identical to the second portion of the first sacrificial section.

The second portions of the first and second sections may cover at least two-thirds of the width of the outer face.

The second portions of the first and second sacrificial sections may have two lateral skies, parallel to the longitudinal direction, the two lateral sides being spaced from one another in a direction transverse to the longitudinal direction so as to create a longitudinal channel between the first and second sacrificial sections.

This longitudinal channel may therefore be delimited between the two lateral sides and the outer face. It may allow the flow of mud during the placement of the formwork element in the trench.

As disclosed above, the second portions may be destroyed during the digging of the adjacent trench and removed from the trench by pumping.

The second sacrificial section may include a third portion disposed along the second lateral edge, the third portion being fastened to the first and second portions of the second sacrificial section. The second sacrificial portion may be one-piece.

The second sacrificial section may be identical to the first sacrificial section, the first and second sacrificial sections extending on either side of the caisson.

The form stripping assistance device may include a plurality of first sacrificial sections disposed one after the other in the longitudinal direction of the formwork element.

The first sacrificial sections may extend over substantially the entire length of the sole plate.

In known fashion, the formwork element may also include a seal which is fastened to the caisson. The seal has a first portion initially disposed at the inside of the caisson and a second portion extending outside the caisson. The seal is substantially perpendicular to the outer face of the sole plate. The second portion of the seal is engaged with the concrete of the first panel after hardening. During withdrawal of the formwork element from the trench, the seal remains in the trench integral with the first panel, the first portion then extending into the adjacent trench.

The present disclosure also relates to a formwork system including a formwork element according to the present disclosure, and a form stripping device including at least one first form stripping hand configured to be moved longitudinally along the first lateral zone of the inner face of the sole plate so as to break at least the first portion of the first sacrificial section.

The form stripping device may be mounted at the end of a digging tool, a skip for example.

The form stripping device may include a second form stripping hand, symmetric with respect to the first form stripping hand, so as to destroy simultaneously the first portions of the first and second sacrificial sections during the vertical movement of the form stripping hands.

The form stripping device may also comprise a movement device for moving the first form stripping hand vertically in the trench along the two lateral skies of the sole plate.

The present disclosure also relates to a form stripping method of a formwork element according to the present disclosure, said formwork element being placed at the end of a first trench filled with concrete, method in which, after hardening, a form stripping hand is moved along the length of the sole plate so that the form stripping hand breaks at least the first portion of the first sacrificial section, then the formwork element is withdrawn from the trench.

Optionally, before movement of the form stripping hand, a second trench may be dug under mud adjacent to the first trench while cutting away the second portions of the first and second sacrificial sections, the segment fragments then being removed by pumping or by the skip during the excavation of the adjacent trench.

Finally, the present disclosure relates to a method for creating a molded wall in the ground, comprising the following steps:

- a first vertical trench of rectangular cross section is dug in the ground, the first trench having a first longitudinal end;
- a formwork element according to the present disclosure is placed in the first trench, in proximity to the longitudinal end;
- the first trench is filled with concrete so as to form a first concrete panel;
- after the hardening of the first concrete panel, a second trench is dug adjacent to the first trench, while cutting away the second portion of the first sacrificial element;
- a first form stripping hand is moved vertically within the thickness of the first portion so as to break said first portion;
- the formwork element is withdrawn from the first trench;
- the second trench is filled with concrete so as to form a second concrete panel.

BRIEF DESCRIPTION OF THE DRAWINGS

The present disclosure will be better understood upon reading the description that follows of an implementation method given by way of a non-limiting example, with reference to the appended drawings, in which.

DETAILED DESCRIPTION

Figure 1:
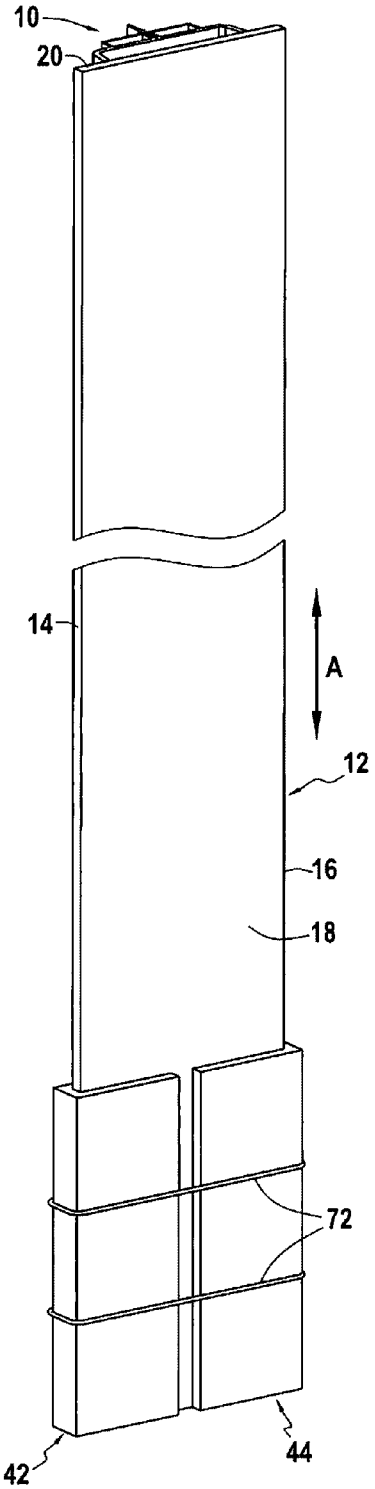
FIG. 1 is a perspective view of an embodiment of a formwork element according to the present disclosure provided with a form stripping assistance device.

One embodiment of a formwork element 10 conforming to the present disclosure will be described by reference to FIGS. 1 to 5. As will be explained in more detail below, the formwork element 10 is intended to be disposed at one end of a vertical trench formed in the ground S. As can be noted in FIG. 1, the formwork element 10 extends in a longitudinal direction A. In operation, the longitudinal direction A is vertical.

The formwork element 10 includes a sole plate 12, preferably made of steel, which has a first lateral edge 14 and a second lateral edge 16, the first and second lateral edges 14, 16 also extending in the longitudinal direction A. Furthermore, the sole plate 12 has an outer face 18 which is planar. In this example, the sole plate has a length of 700 cm and a width of 144 cm. The outer and inner faces are substantially parallel.

Figure 3:
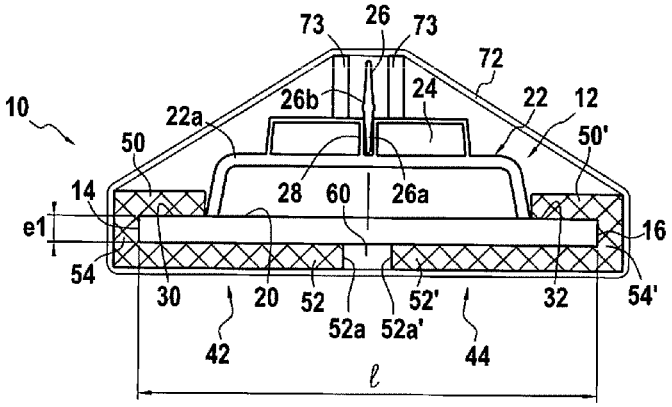
FIG. 3 is a top view of the formwork element of FIG. 1.

The sole plate also has an inner face 20, more visible in FIG. 3, which bears a caisson 22. This caisson 22 is, in this example, welded to the inner face of the sole plate. The caisson 22 has the shape of a bell which extends in the longitudinal direction A, along substantially the entire length of the sole plate. The caisson 22 has a vertex 22*a* distant from the inner face of the sole plate, which comprises a seal carrier 24 to which is fastened a watertight seal 26 which extends in the longitudinal direction A of the sole plate. This watertight seal 26 has a first portion 26*a* which extends inside the caisson 22, and a second portion 26*b* which extends outside the caisson. The first portion 26*a* is inserted into a longitudinal slot 28 which is formed in the seal carrier 24.

Figure 5:
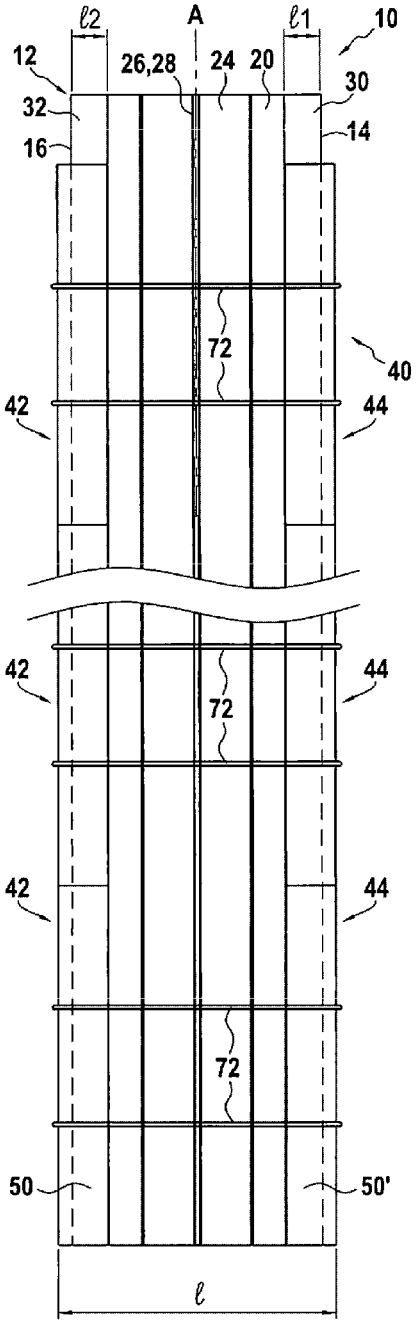
FIG. 5 is a back view of the formwork element of FIG. 4.

As can be noted in FIG. 3, the caisson 22 leaves free, on the inner face 20 of the sole plate 12, a first lateral zone 30 which is defined between the first lateral edge 4 and the caisson 22. The caisson 22 also leaves free on the inner face 20 of the sole plate a second lateral zone 32 which is defined between the second lateral edge 16 and the caisson 22. The first and second lateral zones 30, 32, also visible in FIG. 5, are parallel to the outer face 18.

In this example, the first and second lateral zones 30, 32 are planar and extend in the longitudinal direction A. The width I of the sole plate, considered in a direction transverse to the longitudinal direction A, is on the order of 144 centimeters, while the widths $I_1$, $I_2$ of the first and second lateral zones is on the order of 37 centimeters.

According to the present disclosure, the formwork element 10 also includes a form stripping assistance device 40 which cooperates with the sole plate 12. This form stripping assistance device 40 includes a plurality of first sacrificial sections 42, as well as a plurality of second sacrificial sections 44. The first and second sacrificial sections, when they are mounted on the sole plate, extend in this example in the longitudinal direction of said sole plate.

Figure 2:
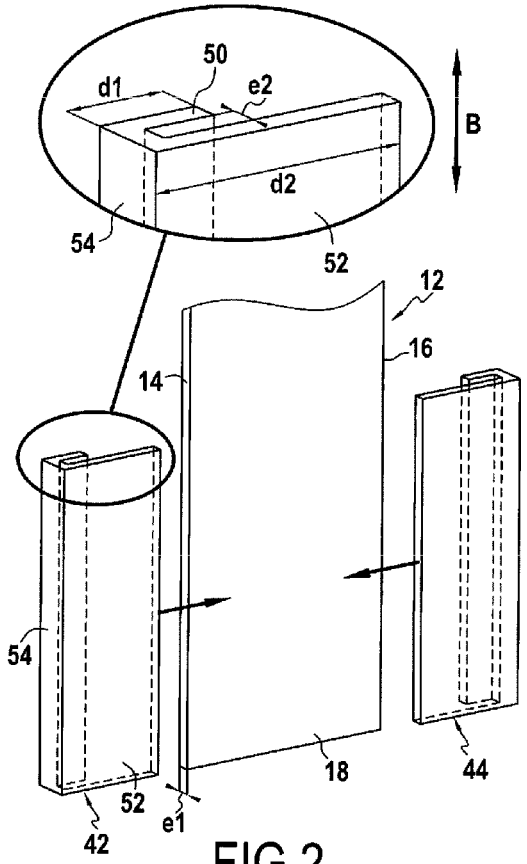
FIG. 2 is an exploded view of the formwork element of FIG. 1, illustrating the placement of the first and second sacrificial sections.

As can be noted in FIG. 2, the first and second sacrificial sections 42, 44 have substantially the same shape and the same dimensions, so that we will limit ourselves to describing in detail the first sacrificial section 42.

It is understood, by reference to FIGS. 1 and 2 that the first sacrificial section 42 comprises a first portion 50, a second portion 52, parallel to the first portion 50, and a third portion 54 which is perpendicular to the first and second portions 50, 52. Each of the first and second portions 50, 52, 54 has the shape of a plate which extends in a longitudinal direction B, which is parallel to the longitudinal direction A when the first section is mounted to the sole plate.

The first portions are disposed over the first lateral zone 30 of the inner face 20 of the sole plate 12.

In this example, the first, second and third portions form a single part. In other words, the first sacrificial section 42 is one-piece. The same is true of the second sacrificial section 44.

In this example, the first sacrificial section 42 consists of a brittle material, in this example, it is polystyrene, the density of which is comprised between 15 and 45 kg/m$^3$.

Furthermore, it is noted that the spacing $e_2$ between the first and second portions 50, 52 of the first sacrificial section 42 corresponds substantially to the thickness $e_1$ of the sole plate 12.

By means of the detail of FIG. 2, it is noted that the first portion 50 has a width $d_1$, considered in a direction perpendicular to the third portion 54. Likewise, the portion 52 has a width $d_2$, considered in a direction perpendicular to the third portion 54. The width $d_2$ of the second portion 52 is larger than the width $d_1$ of the first portion 50.

The width $d_1$ of the first portion 50 is configured in such a manner that, when the first sacrificial section 42 is mounted on the sole plate 12, the first portion 50 covers the first lateral zone 30.

By means of FIG. 3, it is understood that the same is true of the first portion 50' of the second sacrificial section 44.

Figure 4:
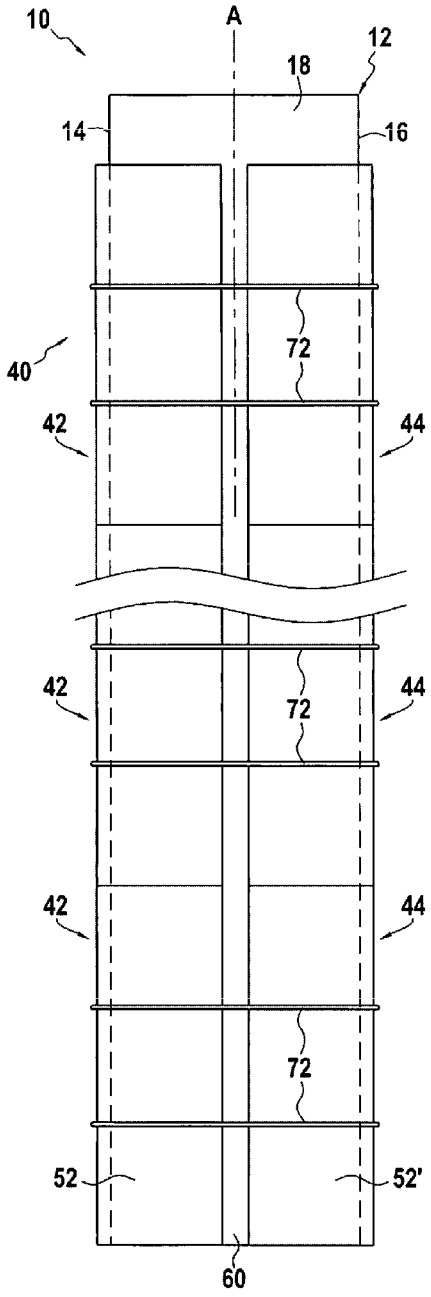
FIG. 4 is a front view of the formwork element of FIG. 1 which includes several form stripping assistance devices.

Referring to FIGS. 3 and 4, it is noted that when the first sacrificial section is mounted on the sole plate, the second portion 52 is disposed on the outer face of said sole plate. The first sacrificial section 42 covers at least one-third of the width I of the sole plate 12.

The same is true of the second portion 52' of the second sacrificial section 44.

Referring to FIGS. 3 and 4, it is noted that the second portions 52, 52' of the first and second sacrificial sections 42, 44 have two lateral sides 52*a*, 52*a*', which are parallel to the longitudinal direction A. These two lateral sides 52*a*, 52*a*' are distant from one another—in a direction transverse to the longitudinal direction A—by a distance f, in this example on the order of 10 cm. This allows creating a longitudinal channel 60 between the second portions 52, 52' of the first and second sacrificial sections 42, 44.

This longitudinal channel 60 facilitates the flow of the digging mud during the placement of the formwork element in the trench.

Referring again to FIGS. 2 and 3, it is noted that the third portion 54 of the first sacrificial section 42 extends along the first lateral edge 14 when the first sacrificial section 42 is mounted to the sole plate 12. In this example, the third portion is supported against the first lateral edge of the sole plate.

Likewise, the third portion 54' of the second sacrificial section 44 is disposed along the second lateral edge 16 when the second sacrificial section is mounted on the sole plate 12.

To retain the first and second sacrificial sections 42, 44 with the sole plate 12, the formwork element 10 also includes a fastening device 70, which, in this example, appears in the form of straps 72 which clasp the sole plate, the caisson and the sacrificial sections. In the example illustrated, two straps 72 have been provided to retain a pair consisting of a first sacrificial section and a second sacrificial section. Naturally, without departing from the scope of the present disclosure it is possible to provide a different number of straps, particularly depending on the length of the sacrificial sections. As illustrated in FIG. 3, in order to protect the watertight seal 26 against crushing, it is possible to provide shims 73 disposed on either side of the seal between the caisson 22 and the straps 72.

Referring to FIGS. 4 and 5, it is noted that the formwork element includes a plurality of first sacrificial sections 42 which are disposed one after the other in the longitudinal direction A, as well as a plurality of second sacrificial sections 44 which are also disposed one after the other in the longitudinal direction A. In this non-limiting example, the pluralities of first and second sacrificial sections 42, 44 are disposed end to end. By means of FIGS. 6A to 6H, an example of a method for creating a molded wall 100 in the ground S will now be described. In this example, the molded wall 100 consists of two concrete panels. Without departing from the scope of the present disclosure, the molded wall obtained by the implementation of the method according to the disclosure can obviously include additional concrete panels.

These figures therefore illustrate the creation of a molded wall in top view, the plane of the sheet corresponding to the horizontal plane.

Figure 6A:
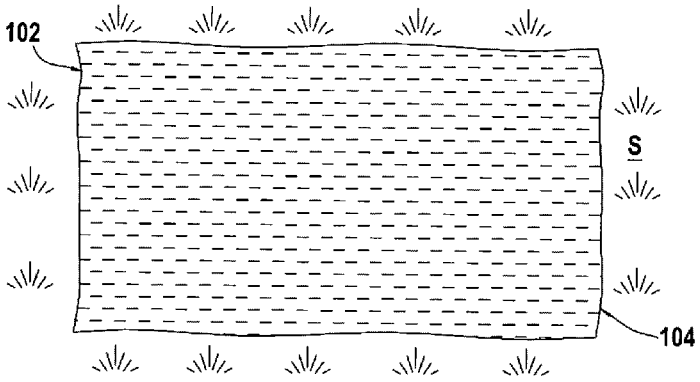
FIGS. 6A to 6H illustrate the method for creating a molded wall according to the present disclosure by means of a formwork system according to the present disclosure.

In FIG. 6A, a first trench 102 is illustrated, which is dug into the ground S by means of a machine known per se, for example a rotary cutting drum cutter. Digging is carried out under mud, i.e. digging mud is injected into the trench during the accomplishment of the excavation, while pumping the mud in order to remove the fragments of excavated soil.

Figure 6B:
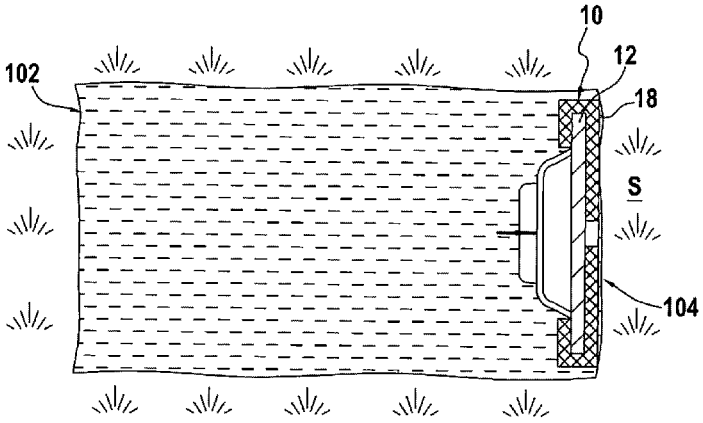

The first trench 102 has a substantially rectangular shape which conventionally includes a first longitudinal end 104. In FIG. 6B, the first trench 102 is illustrated in which has been inserted a formwork element 10 according to the present disclosure. As is observed in FIG. 6B, the longitudinal direction of the formwork element 10 extends vertically, while the outer face 18 of the sole plate 12 is directed toward the end 104 of the first trench 102.

Figure 6C:
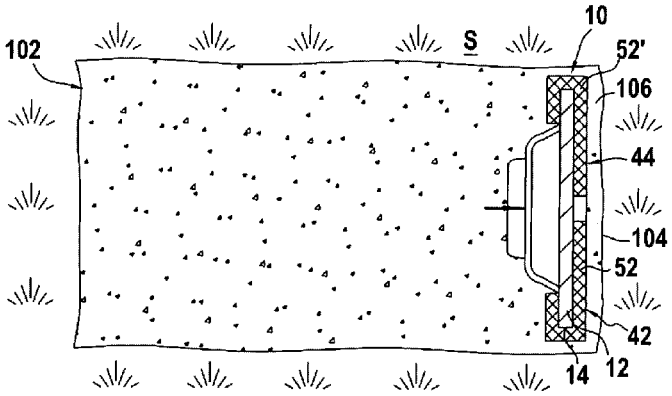
Figure 6D:
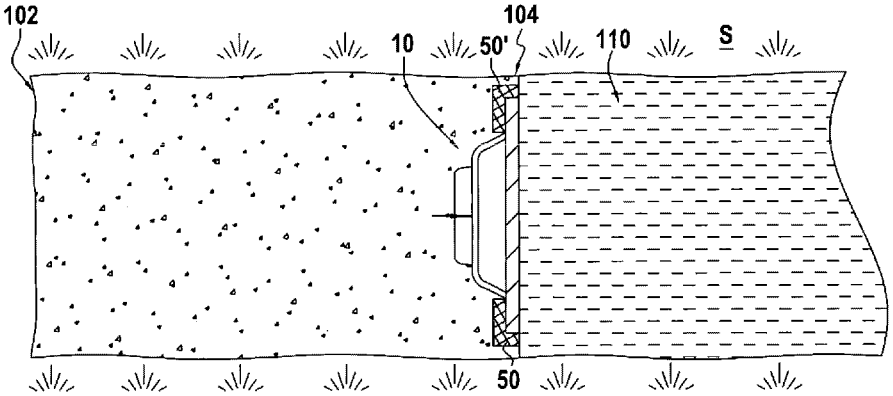

In FIG. 6C, the first concrete panel is illustrated, obtained by filling the first trench 102 with concrete.

During this step, concrete is substituted for the mud 102. Generally, and as shown schematically in FIG. 6C, it is possible for concrete to bypass the first and second lateral edges 14, 16 of the sole plate 12 to lodge between the formwork element 10 and the end 104 of the first trench 102. The thin layer of concrete which can interpose itself between the formwork element and the end 104 of the first trench 102 is labeled 106.

After the hardening of the first concrete panel, a second trench 110 is dug adjacent to the first trench 102. As can be understood by means of FIG. 6D, the second trench 110 is dug in the continuation of the end 104 of the first trench 102. During the digging operation of the second trench 110, the digging tool used cuts away the second portions 52, 52' of the first and second sacrificial elements 42, 44 so that, during the digging of the second trench, the second portions 52, 52' are destroyed and removed from the trench by pumping. There too, the digging is accomplished under mud.

Figure 6E:
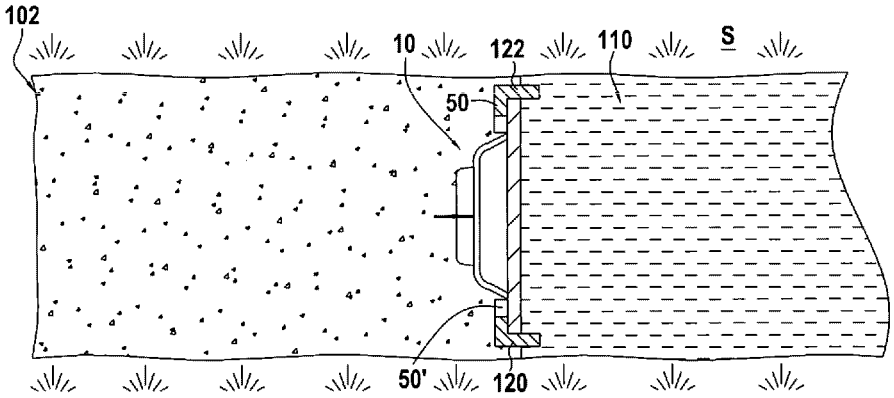

Then, by means of a form stripping device including a first form stripping hand 120 and a second form stripping hand 122, illustrated in FIG. 6E, a form stripping method is implemented to strip the formwork element.

Considered in a substantially horizontal plane, each of the first and second hands has the shape of a hook composed of a first part and a second part perpendicular to the first part. The first part is configured to engage in the thickness of the first portion 50, while the second part is configured to engage in the thickness of the third portion 54.

Within the meaning of the present disclosure, the formwork element and the form stripping device constitute a formwork system.

Figure 6F:
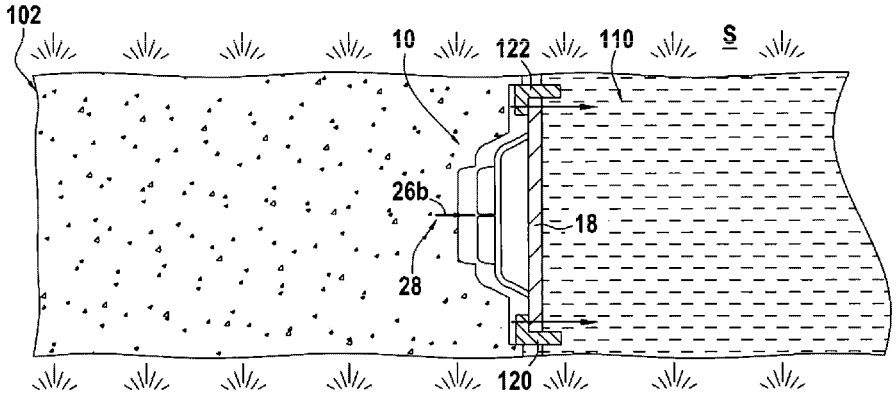

To this end, the first and second form stripping hands 120, 122 are lowered vertically along the first and second lateral zones of the sole plate 12 from the ground surface, so as to engage in the thickness of the first and third portions, this in order to break said first and third portions of the first and second sacrificial sections 42, 44. The passage of the first and second form stripping hands 120, 122 over the inner face of the sole plate is facilitated by the presence of the first portions 50, 50' of the first and second sacrificial sections 42, 44 which are rapidly shredded during the movement of the first and second form stripping hands. Also accomplished, as illustrated in FIG. 6F, is a traction movement in a direction perpendicular to the outer face 18 so as to detach the formwork element 10 from the concrete panel. This also has the effect of freeing the seal 28, the second portion 26*b* of which remains integral with the first concrete panel.

Figure 6G:
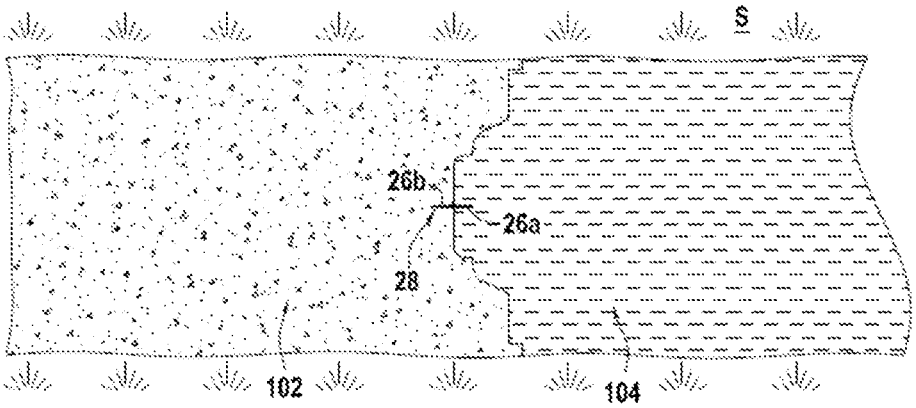
Figure 6H:
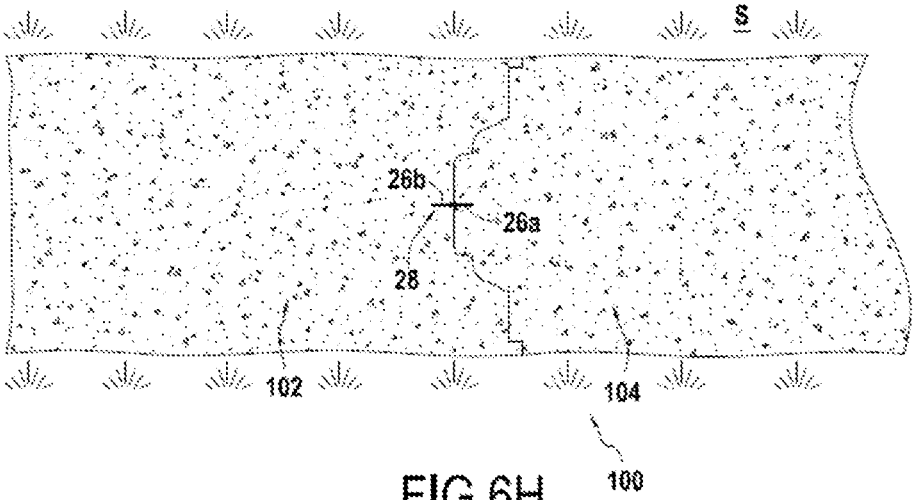

The formwork element is then withdrawn from the ground, so that the mud fills the space which was previously occupied by the formwork element 10, as illustrated in FIG. 6G.

Then, the second trench 104 is filled with concrete so as to obtain, after hardening, a second concrete panel. Thus a molded wall is obtained consisting of the first and second adjacent concrete panels. It is noted that the first portion 28*a* of the seal 28 engages with the hardened concrete of the second portion 104, in order to form the watertight seal between the two concrete wall elements.

The invention claimed is:

1. A formwork element for a molded wall panel end, said formwork element extending in a longitudinal direction and comprising:

a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson;

a form stripping assistance device cooperating with the sole plate;

wherein the form stripping assistance device includes at least one first sacrificial section comprising a first sacrificial section first portion disposed on the first lateral zone of the inner face of the sole plate, the first sacrificial section first portion being comprised of a brittle material.

2. The formwork element according to claim 1, wherein the first sacrificial section further includes a first sacrificial section second portion disposed on the outer face of the sole plate.

3. The formwork element according to claim 2, wherein, considered in a direction transverse to the longitudinal direction, the width of the first sacrificial section first portion is greater than one-third of the width of the first lateral zone, preferably greater than half the width of the first lateral zone.

4. The formwork element according to claim 2, wherein the first sacrificial section further includes a first sacrificial section third portion disposed along the first lateral edge, the first sacrificial section third portion being fastened to the first sacrificial section first and second portions of the first sacrificial section.

5. The formwork element according to claim 4, wherein the first sacrificial section first, second and third portions form a single unitary part.

6. The formwork element according to claim 2, wherein, considered in a direction transverse to the longitudinal direction, the width of the first sacrificial section second portion is greater than one-third of the width of the sole plate.

7. The formwork element according to claim 1, wherein the first sacrificial section is comprised of a brittle material.

8. The formwork element according to claim 7, wherein the brittle material has a density comprised between 10 and 60 kg/m$^3$, preferably comprised between 15 and 45 kg/m$^3$.

9. The formwork element according to claim 7, wherein the first sacrificial section is made of polystyrene.

10. The formwork element according to claim 1, further including a fastening device for fastening the first sacrificial section to the sole plate.

11. The formwork element according to claim 1, further including at least one second sacrificial section including a second sacrificial section first portion disposed on the second lateral zone.

12. The formwork element according to claim 11, wherein the second sacrificial section further includes a second sacrificial section second portion disposed on the outer face of the sole plate.

13. The formwork element according to claim 12, wherein the first sacrificial section further includes a first sacrificial section second portion disposed on the outer face of the sole plate, and wherein the first sacrificial section second portion and the second sacrificial section second portion of the first and second sacrificial sections have two lateral sides, parallel to the longitudinal direction, the two lateral sides being distant from one another in a direction transverse to the longitudinal direction so as to create a longitudinal channel between the first sacrificial section second portion and the second sacrificial section second portion of the first and second sacrificial sections.

14. The formwork element according to claim 12, wherein the second sacrificial section includes a second sacrificial section third portion disposed along the second lateral edge, the second sacrificial section third portion being fastened to the second sacrificial section first and second portions of the second sacrificial section.

15. The formwork element according to claim 1, wherein the form stripping assistance device includes a plurality of first sacrificial sections disposed in the longitudinal direction.

16. A formwork system including:

a formwork element for a molded wall panel end, said formwork element extending in a longitudinal direction and comprising:

a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson;

a form stripping assistance device cooperating with the sole plate;

wherein the form stripping assistance device includes at least one first sacrificial section comprising a first sacrificial section portion disposed on the first lateral zone of the inner face of the sole plate, the first sacrificial section portion being comprised of a brittle material; and a form stripping device including at least one first form stripping hand configured to be moved longitudinally along the first lateral zone of the inner face of the sole plate so as to break at least the first sacrificial section portion of the first sacrificial section.

17. A form stripping method of a formwork element comprising:

providing a formwork element for a molded wall panel end, said formwork element extending in a longitudinal direction and comprising:

a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson;

a form stripping assistance device cooperating with the sole plate;

wherein the form stripping assistance device includes at least one first sacrificial section comprising a first sacrificial section first portion disposed on the first lateral zone of the inner face of the sole plate, the first sacrificial section portion being comprised of a brittle material, the first sacrificial section also including a first sacrificial section second portion disposed on the outer face of the sole plate;

placing said formwork element at the end of a trench filled with concrete, moving a form stripping hand along the length of the sole plate so that the form stripping hand breaks at least the first sacrificial section first portion of the first sacrificial section, and withdrawing the formwork element from the trench.

18. A method for creating a molded wall in the ground, comprising the following steps:

providing a formwork element for a molded wall panel end, said formwork element extending in a longitudinal direction and comprising:

a sole plate having a first lateral edge, a second lateral edge, an outer face, an inner face bearing a caisson, said caisson leaving free, on the inner face of the sole plate, a first lateral zone, defined between the first lateral edge and the caisson, and a second lateral zone, defined between the second lateral edge and the caisson;

a form stripping assistance device cooperating with the sole plate;

wherein the form stripping assistance device includes at least one first sacrificial section comprising a first sacrificial section first portion disposed on the first lateral zone of the inner face of the sole plate, the first sacrificial section first portion being comprised of a brittle material, the first sacrificial section also including a first sacrificial section second portion disposed on the outer face of the sole plate;

digging a first vertical trench of rectangular cross section in the ground, the first trench having a first longitudinal end;

placing said framework element in the first trench, in proximity to the longitudinal end;

filling the first trench with concrete so as to form a first concrete panel;

after the hardening of the first concrete panel, digging a second trench adjacent to the first trench, while cutting away the first sacrificial section second portion of the first sacrificial element;

moving a first form stripping hand vertically within the thickness of the first sacrificial section first portion so as to break said first sacrificial section first portion;

withdrawing the formwork element from the first trench;

filling the second trench with concrete so as to form a second concrete panel.

* * * * *